US010163408B1

(12) United States Patent
Chen et al.

(10) Patent No.: US 10,163,408 B1
(45) Date of Patent: Dec. 25, 2018

(54) LCD IMAGE COMPENSATION FOR LED BACKLIGHTING

(71) Applicant: PIXELWORKS, INC., Portland, OR (US)

(72) Inventors: Tao Chen, Shanghai (CN); Bob Zhang, Santa Clara, CA (US)

(73) Assignee: PIXELWORKS, INC., Portland, OR (US)

( * ) Notice: Subject to any disclaimer, the term of this patent is extended or adjusted under 35 U.S.C. 154(b) by 112 days.

(21) Appl. No.: 14/478,378

(22) Filed: Sep. 5, 2014

(51) Int. Cl.
*G09G 3/34* (2006.01)
*G09G 3/36* (2006.01)

(52) U.S. Cl.
CPC ..... *G09G 3/36* (2013.01); *G09G 3/3406* (2013.01); *G09G 2320/0285* (2013.01); *G09G 2320/0606* (2013.01); *G09G 2360/144* (2013.01)

(58) Field of Classification Search
CPC ..... G09G 3/3406; G09G 2320/0285; G09G 2320/0606; G09G 2360/144
See application file for complete search history.

(56) References Cited

U.S. PATENT DOCUMENTS 6,694,051 B1 * 2/2004 Yamazoe ..... G06T 5/009 358/1.9
8,564,528 B1 * 10/2013 Chen ..... G09G 3/342 345/102
2003/0012437 A1 * 1/2003 Zaklika ..... G06T 5/40 382/169
2003/0081133 A1 * 5/2003 Lee ..... H04N 5/23293 348/229.1
2004/0136605 A1 * 7/2004 Seger ..... H04N 5/20 382/274
2004/0143380 A1 * 7/2004 Stam ..... B60Q 1/085 701/36
2007/0001997 A1 * 1/2007 Kim ..... G09G 3/3406 345/102
2007/0002003 A1 * 1/2007 Kim ..... G09G 3/342 345/102
2007/0081721 A1 * 4/2007 Xiao ..... G06T 5/009 382/167
2007/0097069 A1 * 5/2007 Kurokawa ..... G09G 3/2092 345/102
2007/0188623 A1 * 8/2007 Yamashita ..... G06T 5/004 348/222.1
2008/0007512 A1 * 1/2008 Honbo ..... G09G 3/3406 345/102
2008/0231581 A1 * 9/2008 Fujine ..... G09G 3/3406 345/98
2008/0284719 A1 * 11/2008 Yoshida ..... G02F 1/136277 345/102
2008/0284721 A1 * 11/2008 Hasegawa ..... G09G 3/3406 345/102
2009/0009455 A1 * 1/2009 Kimura ..... G09G 3/2074 345/89

(Continued)

*Primary Examiner* — Michael J Eurice
(74) *Attorney, Agent, or Firm* — Miller Nash Graham & Dunn LLP

(57) ABSTRACT

A method includes determining a display backlight level based upon an ambient light level, using image content of incoming image data to adjust the display backlight level based upon image content to produce an image-compensated backlight value, and adjusting pixel values in the image data as needed based upon the image-compensated backlight value.

18 Claims, 6 Drawing Sheets

(56) References Cited

U.S. PATENT DOCUMENTS

2009/0009464 A1* 1/2009 Kohashikawa ..... G09G 3/3406 345/102
2009/0015541 A1* 1/2009 Honbo ..... G09G 3/342 345/102
2009/0122073 A1* 5/2009 Higgins ..... G09G 3/2003 345/590
2009/0167658 A1* 7/2009 Yamane ..... G09G 3/3406 345/89
2009/0174636 A1* 7/2009 Kohashikawa ..... G09G 3/3406 345/87
2009/0184915 A1* 7/2009 Tsai ..... G09G 3/3406 345/102
2009/0262063 A1* 10/2009 Fujine ..... G09G 3/3406 345/102
2009/0268105 A1* 10/2009 Kohashikawa ..... G09G 3/3406 348/790
2009/0273614 A1* 11/2009 Higgins ..... G09G 5/02 345/690
2010/0026703 A1* 2/2010 Parker ..... G02B 6/0046 345/589
2010/0195906 A1* 8/2010 Uliyar ..... G06T 5/008 382/167
2010/0277515 A1* 11/2010 Ward ..... G09G 3/3426 345/690
2010/0295877 A1* 11/2010 Yun ..... G09G 3/3406 345/690
2011/0037784 A1* 2/2011 Shiomi ..... G09G 3/3426 345/690
2011/0037785 A1* 2/2011 Shiomi ..... G09G 3/3426 345/690
2011/0123129 A1* 5/2011 Lee ..... G09G 3/2051 382/252
2011/0141090 A1* 6/2011 Hong ..... G09G 3/3426 345/211
2012/0057084 A1* 3/2012 Sano ..... G09G 3/3426 348/790
2012/0075362 A1* 3/2012 Ichioka ..... G09G 3/3426 345/690
2012/0120089 A1* 5/2012 Byun ..... G09G 3/3406 345/589
2012/0120096 A1* 5/2012 Johnson ..... G09G 3/2048 345/596
2012/0147067 A1* 6/2012 Hashimoto ..... G09G 3/3413 345/690
2012/0154459 A1* 6/2012 Otoi ..... G09G 3/3426 345/690
2012/0256892 A1* 10/2012 Hung ..... G09G 3/3406 345/207
2012/0268436 A1* 10/2012 Chang ..... G09G 3/34 345/207
2012/0281027 A1* 11/2012 Kim ..... G09G 3/3406 345/690
2012/0287093 A1* 11/2012 Gotoh ..... G06F 3/0412 345/204
2012/0287141 A1* 11/2012 Higgins ..... H04N 19/59 345/581
2012/0320105 A1* 12/2012 Ueno ..... G09G 3/3426 345/690
2013/0033583 A1* 2/2013 Lee ..... H04N 13/0409 348/47
2013/0170540 A1* 7/2013 Damkat ..... G09G 3/3426 375/240.01
2013/0315505 A1* 11/2013 Atkins ..... G06T 3/4007 382/300
2014/0003715 A1* 1/2014 Tsai ..... H04N 19/80 382/167
2014/0049571 A1* 2/2014 Erinjippurath .... G02F 1/133606 345/690
2014/0152720 A1* 6/2014 Kim ..... G09G 3/3406 345/691
2014/0168288 A1* 6/2014 Tusch ..... G09G 5/00 345/690
2014/0225943 A1* 8/2014 Shiobara ..... G09G 3/3413 345/694
2014/0306943 A1* 10/2014 Kuo ..... G09G 3/3406 345/207
2015/0109325 A1* 4/2015 Yata ..... G09G 3/2003 345/601
2015/0245043 A1* 8/2015 Greenebaum ..... H04N 19/98 375/240.25
2016/0248939 A1* 8/2016 Thurston, III ..... H04N 1/603
2017/0103711 A1* 4/2017 Kamio ..... G09G 3/3406

* cited by examiner

LCD IMAGE COMPENSATION FOR LED BACKLIGHTING

BACKGROUND

Liquid crystal display systems typically use backlights. Traditionally, the backlight produced constant and even light regardless of the content, with the liquid crystal cells controlling the brightness of the image. However, constant backlights have some disadvantages in high power consumption especially at high ambient light, heat generation and reduction in the dynamic range of the display. One solution for better control of the backlight replaces the constant backlight panel with an array of solid-state light emitters, such as light-emitting diodes (LEDs), with the number of LEDs being far less than the number of LCD elements. This allows for adjustment of the backlight according to the brightness in regions of the image, but has the disadvantage of increasing the cost and size of the device. Therefore, there is a desire to use the fewest possible zones. In the extreme case of a single zone, the overall brightness of the entire image can used.

When using a backlight, the input image is typically downsampled to a resolution that corresponds to the LED array size. There are several methods that can be used to down sample the data. One method lowpass filters the data before downsampling and then adjusts that data to take into account the amount of light leaking from adjacent LED zones, where a zone consists of the area that is in front of the LED. Each zone represents the LCD elements/pixels closest to a particular LED, or group of LEDs, that are controlled together. To save driver cost and allow for a thinner panel a zone might consist of several LEDs that are controlled together so that they act like a single LED at a larger distance from the LCD panel.

Another method controls the LED value based on the maximum image data value for an LED zone. Another method might look at the histogram data of the input image associated with the zone. In any of the above approaches, the zone area might also be increased so that it overlaps with adjacent zones. In addition, low pass filtering might be combined with the other methods. Some systems may also apply a spatial or temporal weight to the data. These approaches represent just some of the ways of calculating the LED values.

However they are determined, once one has the LED values for the LED array, the system needs to adjust the input image pixels to achieve a desired image value. A typical desired image value is the input image value. The image value results from the LED backlight illumination at a pixel multiplied by the transmittance of the pixel.

When the dynamic range of a display is increased, it may also be desirable to increase the dynamic range and/or adjust the look of the image to take advantage of the increase. In addition, because the frequency response of the LED resolution is much lower than the input image, compromises might be required to reduce the level of artifacts or reduce power. In addition, for high ambient light levels, the max LED illumination required may not be enough. These compromises might result in an LED illumination too low to allow the perfect reproduction of the original image. That is, it might require a pixel transmittance of greater than 100%, which is impossible. In the current art, a value corresponding to a transmittance of greater than 100% requires either a soft clipping circuit or results in areas of the image with no detail.

DETAILED DESCRIPTION OF THE EMBODIMENTS

In different light conditions, the relative brightness perception produced by the same actual screen brightness is different. In an outdoors light environment, the phone screen is too dark, but in a dark environment, the phone screen is too bright.

Ambient light and adaptive display adjustment is used to increase or decrease the display backlight and pixel values depending on the environment and picture content. This adjustment can dramatically improve the visibility and reduce power consumption at the same time. An ambient light sensor measures the ambient light illumination.

For mobile devices equipped with a LCD (Liquid Crystal Display), the backlight consumes a considerable percentage of the total energy. The backlight of the typical handheld device consumes 20%-40% of the total system power. Dynamically dimming the backlight is considered an effective method to save energy. Based on image content, the backlight level is automatically decreased and the image pixel values are correspondingly changed. Backlight dimming reduces power consumption. Using pixel compensation the pixel value is increased to match perceived image luminance before and after backlight adjustment.

The embodiments here rely upon a novel ambient light and adaptive display adjustment method. Both the display backlight and the image pixels are adjusted for better viewing performance and lower power consumption. If the environment is dark, the backlight is decreased and the image pixels are changed only based on the image content. That is, if the image is dark, then the backlight will be decreased from the ambient light setting and the pixel values increased to save power. The display backlight will be increased along with the increasing environment brightness. If the upper limit of display backlight is still not enough for the current ambient light, the pixel values will also be increased using a similar pixel compensation process resulting in better viewing for high ambient light conditions.

Figure 1:
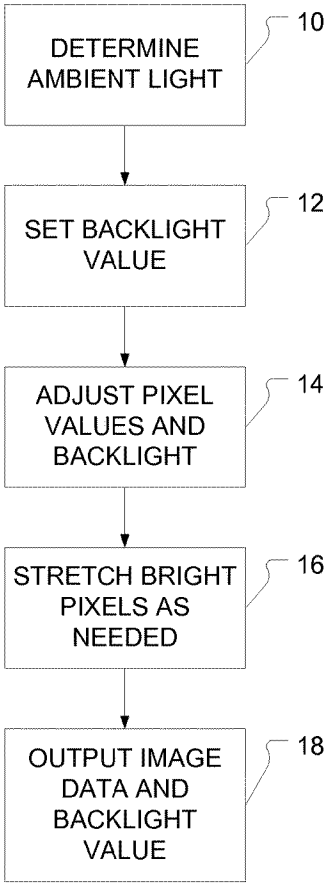
FIG. 1 shows a flowchart of an embodiment of a method of adaptively adjusting a display backlight based on ambient light.

FIG. 1 shows a flowchart of an overall process for adjusting the backlight of a display. At 10, the system determines an ambient light level, typically with a sensor. The backlight value is set, typically by the user, at 12. The pixel values and the backlight values are adjusted as needed at 14. In some instances, as will be discussed in more detail below; bright pixels may be further adjusted as needed in 16. Finally, the output image data and backlight value are output to the display at 18.

Figure 2:
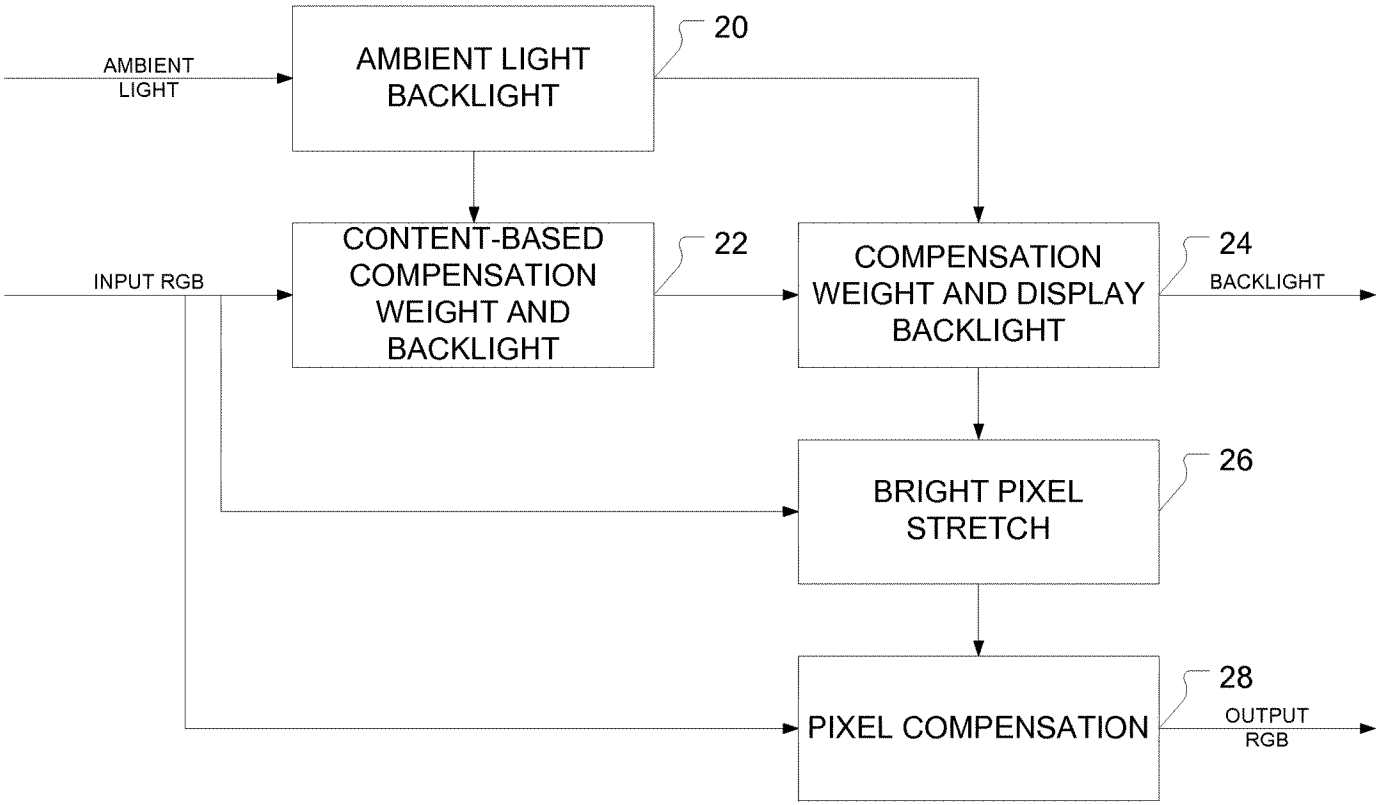
FIG. 2 shows a more detailed flowchart of an embodiment of a method of adaptively adjusting a display backlight based on ambient light.

FIG. 2 shows a flowchart of an embodiment of a method to adjust the backlight of a display based upon ambient light. After the ambient light backlight is calculated at 20, the content-based pixel compensation weight and backlight can be obtained at 22. Combined with the ambient light backlight, the final compensation weight and the output backlight are calculated at 24. Pixel compensation is used to adjust the pixel value. Bright pixel stretch is used to increase the contrast of high grayscale pixels if there are many bright pixels in the image at 26. This will help protect the contrast because pixel compensation will mostly compress the contrast of high grayscale pixels. While dark pixels are increased in value as the ambient light increases. Finally the output image data is produced at 28.

Figure 3:
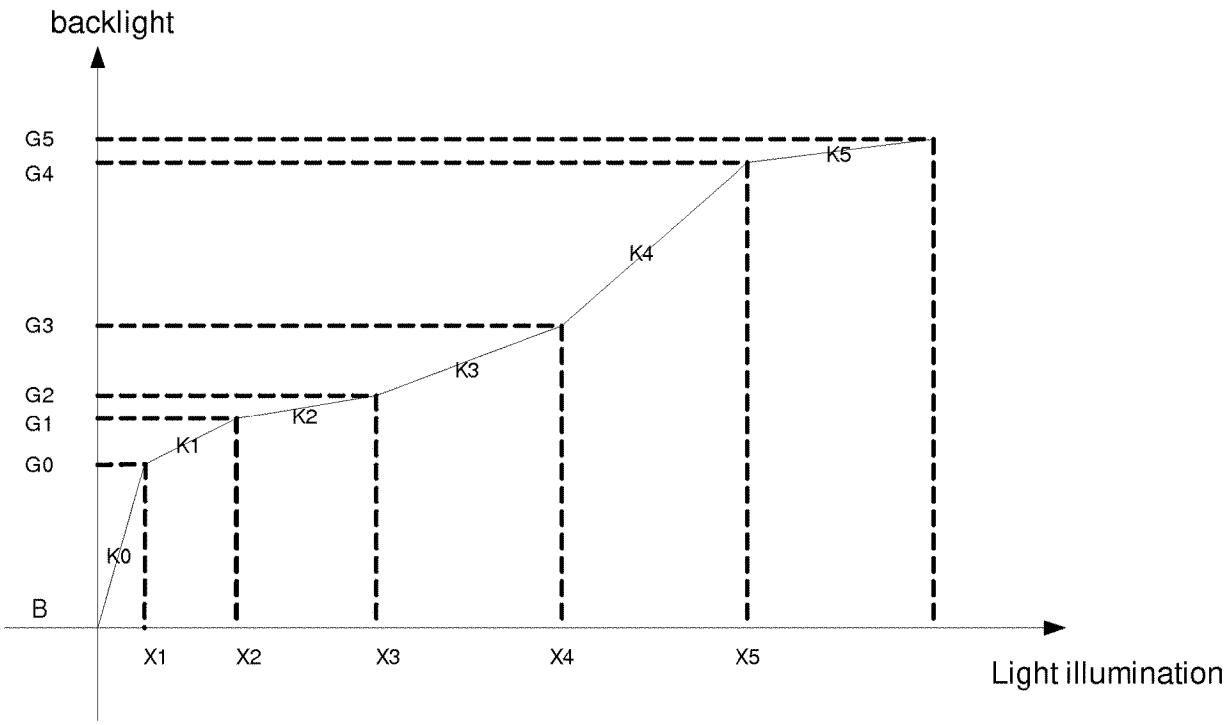
FIG. 3 shows an embodiment of a piecewise linear function of ambient light versus display backlight values.

The process first calculates the necessary backlight level suitable to display content at the current the ambient light. A piece-wise linear function as shown in FIG. 3 is used to map the measured light illumination to the required display backlight. For normal indoor light, the backlight is set equal to a value determined by the user. If the actual environment is darker, the backlight is less than the value. Conversely if the ambient light is brighter, the calculated backlight is larger than the value.

Based on image content, the pixel compensation weight and the amount to decrease the backlight can be obtained. If the image is dark, the compensation weight is large and the backlight level is decreased from the value determined by the ambient light. Pixel compensation is used to adjust the pixel value if necessary. The compensation weight depends on both the ambient light backlight and image content. The content backlight and the ambient light backlight will be combined to get the actual output backlight sent to the display. While the final compensation weight is sum of the content compensation weight and the ambient light compensation weight.

If the ratio of the upper limit of the display backlight to the multiplication of the ambient light backlight and the content backlight is larger than 1, then the ambient light compensation weight is zero. Otherwise, the smaller the ratio, the larger the compensation weight.

As discussed above, the system first determines the backlight value. Based on ambient light illumination, the backlight value suitable to the viewer is calculated. First, a piece-wise linear function is used to map the ambient light sensor value to the ambient light backlight.

$$\text{BL_AL_raw} = \begin{cases} \min(G0,\ B + K0 * AL), & AL \le X1, \\ \min(G1,\ G0 + K1 * (AL - X1)), & X1 < AL \le X2, \\ \min(G2,\ G1 + K2 * (AL - X2)), & X2 < AL \le X3, \\ \min(G3,\ G2 + K3 * (AL - X3)), & X3 < AL \le X4, \\ \min(G4,\ G3 + K4 * (AL - X4)), & X4 < AL \le X5, \\ \min(G5,\ G4 + K5 * (AL - X5)), & AL > X5, \end{cases}$$

where, AL is the ambient light illumination, BL_AL_raw is the calculated AL backlight. Note that BL_AL_raw may be larger than the upper limit of the display backlight. That is, it may have a value greater than 1.

The process then does temporal filtering of AL backlight. The basic formula of temporal filtering is as follows:

$$BL_AL_i = \text{Gain_}TF * (BL_AL_{i-1} - BL_AL_raw) + BL_AL_raw,$$

where $BL_AL_{i-1}$ is previous AL backlight after temporal filtering, $BL_AL_i$ is current AL backlight after temporal filtering, $0 \le \text{Gain_}TF \le 1$ is the gain of temporal filtering.

Figure 4:
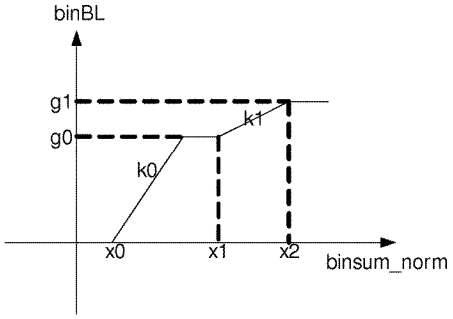
FIG. 4 shows an alternative embodiment of a piecewise function of ambient light versus display backlight values.

After determining the back light value, an image luma histogram is used to calculate the content compensation weight. The pixel luma is equal to max(R,G,B) for the pixel (R,G,B). The bin number of histogram can be selected in the range from 8 to 64. Each bin stores the sum of all pixel luma located in this bin. For each bin, sum of pixel luma is normalized by dividing by image width and image height, or by the width and height of the LED zone if being used with a display with more than one LED backlight zone. Denote the normalized sum by binsum_norm(i), $0 \le i \le N-1$, i is the bin number of histogram. The piece-wise mapping curve is used to map the normalized bin sum to the bin backlight. Each bin sum has a unique piece-wise mapping cure. FIG. 4 shows an embodiment of such a curve. For binsum_norm (i), the bin backlight binBL(i), $0 \le i \le N-1$, is obtained using the following formula:

$$binBL(i) = \begin{cases} 0, & \text{binsum_norm}(i) \le x0(i) \\ \min(g0(i),\ k0(i) * (\text{binsum_norm}(i) - x0(i))), & x0(i) \le \text{binsum_norm}(i) \le x1(i) \\ \min(g1(i),\ k1(i) * (\text{binsum_norm}(i) - x0(i)) + g0(i)), & \text{binsum_norm}(i) > x1(i) \end{cases},$$

where $x0(i) \ge 0$, $k0(i) \ge 0$, $g0(i) \ge 0$, $k1(i) \ge 0$, $g1(i) \ge 0$ are parameters.

Figure 5:
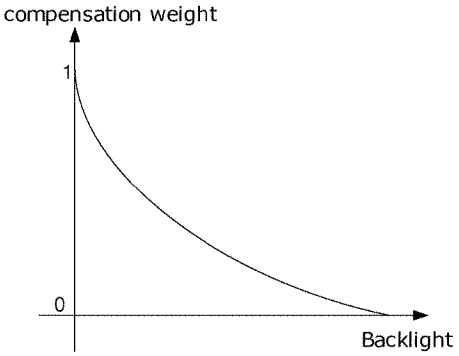
FIG. 5 shows a graph of a backlight versus pixel compensation eight.

Based on bin backlight, histogram backlight histBL can be obtained. It can be calculated using the max of binBL(i), $0 \le i \le N-1$ or be sum of binBL(i), $0 \le i \le N-1$. If histBL is small, the content-based compensation weight is large. The content-based compensation may also be referred to as the LCD compensation, where LCD represents the display panel whether or not an actual LCD panel or other pixelated display is used. If histBL is large, the content-based compensation weight is small. For example, the function of the content-based pixel compensation weight, w_compen_C can be taken as $$f(x) = (1-x)^3,$$

where, x denotes histBL, f(x) is the compensation weight. For hardware implementation, a LUT can be used to store the compensation weight to the backlight for additional flexibility. FIG. 5 shows an example from the backlight to the pixel compensation weight.

The luma average of the original image and the luma average of the maximum compensated image are used to calculate the backlight. The pixel luma is calculated by max(R,G,B) for the pixel (R,G,B). The original luma average (org_avg) is equal to sum of original pixel luma divided by the number of image pixels. For max compensated image, the luma average (max_compen_avg) is equal to sum of its compensated pixel luma divided by the number of image pixel assuming that the compensation weight (w_compen_C) equals one. This allows all the values necessary to calculated the back light value to be obtained as the image is received. The details of calculating the pixel compensation and w_compen_C is in subsection-"pixel compensation".

After original luma average org_avg, max compensation luma average max_compen_avg and content-based compensation weight w_compen_c are obtained, the content-based backlight adjustment is calculated as the following formulas:

$$compen_avg=org_avg+w_compen_C*(max_compen_avg-org_avg),$$

$$BL_C=\left(\frac{org_avg}{compen_avg}\right)^{\alpha}$$

where, $\alpha\leq 0$ can be taken as 2.2 for typical LCD panel and LED response curves. For hardware implementation, the value $(\bullet)^{\alpha}$ may be stored in a LUT. Because org_avg≤compen_avg, BL_C is in the interval [0,1]

The content backlight and the ambient light backlight are combined to get the output backlight as follows:

$$BL_ALC=BL_AL*BL_C*BL_USER$$

BL_o=min(BL_LMT, BL_AL_C), where, BL_AL is ambient light backlight, BL_C is content backlight, BL_USER is max backlight set by the user, BL_LMT denotes the upper limit of backlight for current setting and it may be BL_USER, 100% of screen max backlight or somewhere in between depending on the specific implementation by the manufacturer. The manufacturer might also make this dependent on the battery capacity remaining or whether or not the device is plugged in or not.

If the required backlight BL_AL_C is larger than the upper limit of the panel backlight, the ambient light compensation is also needed. If BL_AL_C is not larger than BL_LMT, the ambient light compensation weight (w_compen_AL) is zero. In addition, if automatic adjustment of the backlight based on ambient light is turned off, then w_compen_AL will also be zero because BL_AL is forced to be less than BL_LMT. If BL_AL_C is larger than BL_LMT, then the screen backlight isn't enough for the ambient light and the image content. That is, the actual backlight level is lower than what was used to calculate the content based compensation value. Therefore, the ambient light pixel compensation should take effect. The smaller min(1, BL_LMT/BL_AL_C) is, the larger the compensation weight. If BL_LMT/BL_AL_C is close to zero, the compensation weight is large and close to one. Similar to the calculation of the content compensation weight, such as $f(x)=(1-x)^3$ or in general a one-dimensional look-up table (1D LUT), the compensation weight w_compen_AL can be obtained. The final pixel compensation weight is sum of the content compensation weight and the ambient light compensation weight, for example $$w_compen=\min(1, w_compen_C+w_compen_AL).$$

For better pixel compensation for the ambient light, a pixel offset may also used and is discussed in more detail below. The larger the w_compen_AL, the larger compensation offset.

Pixel compensation is used to increase the pixel value if necessary. For example, if the ambient light backlight is larger than the upper limit of the screen backlight or the backlight is decreased for the image content. Based on the compensation weight and the compensation gain curve, each pixel is adjusted. The relationship between the compensation gain curve and the compensation curves is as follows:

$$pixel\ compensation\ gain=(compensated\ pixel)/(original\ pixel).$$

For a strictly accurate representation, the compensation gain curve would equal a constant, but doing so does not adjust the dynamic range or provide a soft clip. Therefore, the curve in general is a more complex function.

Figure 7:
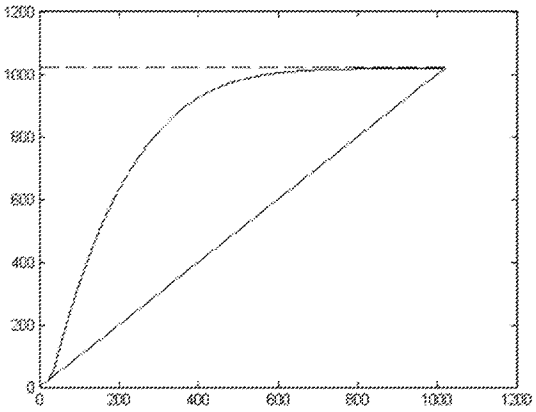
FIG. 7 shows graphical examples of compensation and gain curves without offsets.
Figure 7:
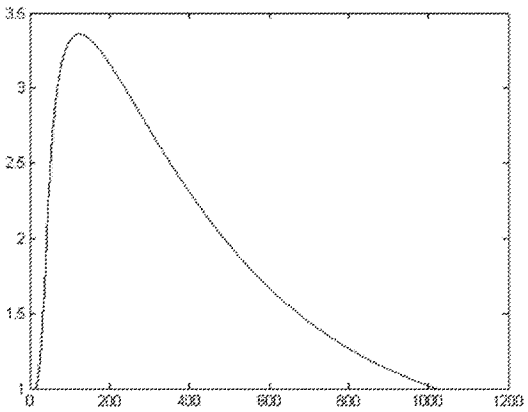
Figure 8:
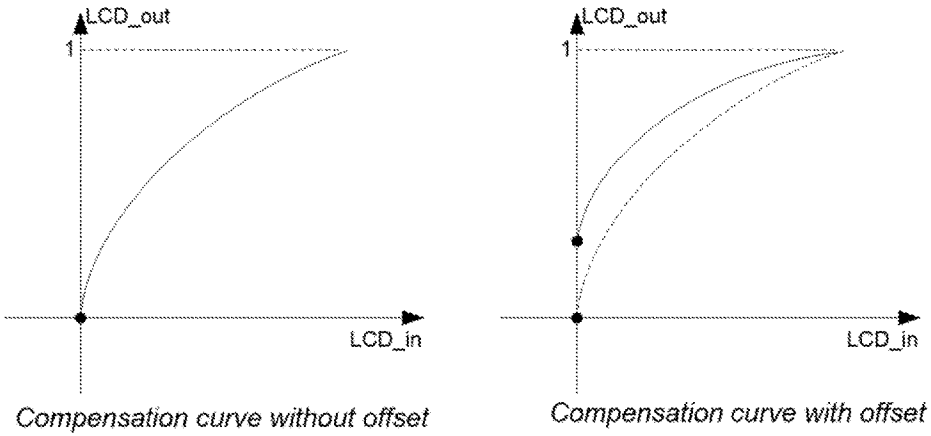
FIG. 8 shows graphic examples of compensation and gain curves with offset.

For detail implementation, the compensation curve is replaced by the compensation gain curve. FIG. 7 shows a pair of the compensation curve and the compensation gain curve. For better display performance, an offset is also used to adjust the pixel if the ambient light compensation weight is larger than zero. But other functions that also increase the contrast of low value pixels are possible. FIG. 8 shows an example of the compensation curve without offset and the compensation curve with offset.

A LUT may store the max compensation gain curve for different gray level. For a pixel (R,G,B), the adjusted pixel is obtained as follows:

RGB Bright Pixel Stretch:

$$(R',G',B')=(R,G,B)*gain_BS(Y),$$

where, Y is equal to max(R,G,B), gain_BS is the adjustment gain of bright pixel stretch.

Compensation Gain Calculation:

$$gain_compen=1+w_compen*(gain_max(Y')-1),$$

where, Y' is equal to max(R',G',B'), gain_max is the max compensation gain stored in a 1D LUT of max compensation gain.

Rgb Compensation:

$$(R'',G'',B'')=gain_compen*(R',G',B'),$$

where, (R",G",B") is the compensated pixel.

AL Offset Adjustment:

$$(R''',G''',B''')=Offset_AL+(1-Offset_AL)*(R'',G'',B''),$$

where Offset_AL=w_offset_AL*max_Offset_AL, 0≤rmax_Offset_AL≤1 is a parameter.

As discussed above, bright pixels may undergo stretching because image compensation will reduce the contrast of high grayscale pixels. Bright pixel stretch is used to compensate for the contrast loss. 8-bin grayscale histogram is generated to represent the grayscale distribution of the image. Based on the histogram, each grayscale obtains a contrast adjustment gain.

For an 8-bin histogram, each bin stores the number of the pixels that fall in the range of the bin. For each pixel (R,G,B), max(R,G,B) is taken as the pixel grayscale. After dividing by the image width and image height, a histogram can represent the grayscale distribution of all the pixels in the image. Denote the histogram by hist_BS[0~7]. The contrast adjustment deltas are calculated as follows:

$$delta[i]=\min(Lmt_Delta_BS[i], K_Delta_BS[i]*\max(0, hist_BS[7-i]-TH_HIST_BS)), i=0, \ldots, 4,$$

where, Lmt_Delta_BS[0~4]≥0, K_Delta_BS[0~4]≥0 and TH_HIST_BS≥0 are parameter.

Low-pass filtering of the histogram is used to increase the stability of the deltas:

$$delta_LP[i]=delta[i]+K_LPF_BS*(delta[i+1]-delta[i]), i=0, \ldots, 3,$$

where, 0≤K_LPF_BS≤1 denote the gain of low-pass filtering.

Temporal filtering of the contrast delta is used to improve temporal stability:

$$delta_TP[i,t]=delta_LP[i]+K_TF_BS*(delta_TP[i,t-1]-delta_LP[i]), i=0, \ldots, 4,$$

where, 0≤K_TF_BS≤1 denote the gain of temporal filtering.

If the pixel compensation weight is small, the contrast loss of high grayscale pixels is small. Therefore, the contrast delta is multiplied by the pixel compensation weight to reduce the value:

$$\text{delta_}BS[i]=\text{delta_}TP[i]*w\text{_compen},i=0,\ldots,4,$$

where, $0 \le w_compen \le 1$ denote the compensation weight.

Figure 6:
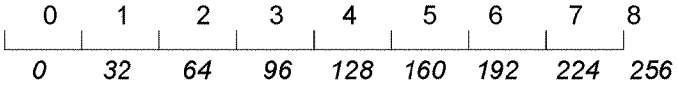
FIG. 6 shows a representation of histogram bins.

Based on the contrast delta, bright pixel stretch will calculate the corresponding adjusted grayscale value after contrast adjustment. Denote the adjusted value by value_BS[0~8]. For 8 bit grayscale value, the original value of value_BS[0~8] is {0,32,64,96,128,160,192,224,256}, shown in FIG. 6. For value_BS[3~7], accumulated contrast delta is added into the original to get the destination. Linear interpolation of zero and value_BS[3] is used to calculate value_BS[1] and value_BS[2]. The detail formulas are as follows:

$$\text{value_BS}[8] = 2^{BIT},$$

$$\text{value_BS}[7-i] = 2^{(BIT-3)}*(7-i) - \sum_{j=0}^{i} \text{delta_BS}[j],\ i = 0, \ldots, 4,$$

$$\text{value_BS}[2] = 2/3*\text{value_BS}[3]$$

$$\text{value_BS}[1] = 1/3*\text{value_BS}[3],$$

$$\text{value_BS}[0] = 0,$$

where BIT denotes the bit width of the grayscale value and for 8 bit video, BIT=8.

Figure 9:
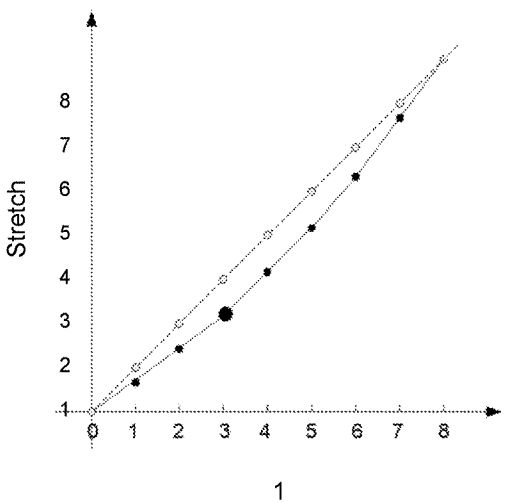
FIG. 9 shows a graphical representation of an example of a bright pixel stretch.

FIG. 9 shows an example curve of value_BS[0~8]. After obtaining the stretched value value_BS[0~8], linear interpolation is used to generate the adjusted grayscale value for all grayscale levels. For pixel hue preservation, the stretched value is converted into the stretch gain. The multiplication of the original RGB pixel and the stretch gain is just the result of bright pixel stretch. The gain is equal to the adjusted value divided by the original value.

In this manner, an ambient light adjustment to a display backlight is accomplished. The adjustment takes into account not only the ambient light in the environment of the display, but the image content to be displayed as well. The image data is adjusted based upon the content and the backlight to arrive at new output image data and backlight values to be displayed.

Although there has been described to this point a particular embodiment for a method and apparatus for image data based compensation for an LED backlight, it is not intended that such specific references be considered as limitations upon the scope of this invention except in-so-far as set forth in the following claims.

What is claimed is:

1. A method, comprising:

determining a display backlight level based upon an ambient light level;

determining a weighted histogram of image pixel values of incoming image data, wherein each count added to a histogram bin in the weighted histogram is weighted by a value of an image pixel, and each histogram bin of the weighted histogram is mapped to a bin backlight value;

using the weighted histogram of image pixel values of incoming image data to produce a content backlight value and content-based compensation weights for each pixel in the incoming image data;

finding a final backlight level based upon the display backlight level and the content backlight values;

limiting the final backlight level to find an actual backlight level; and adjusting the image pixel values of the incoming image data as needed based upon initial pixel values in the incoming image data, the content backlight value, the content-based compensation weights, the final backlight level, and the actual backlight level.

2. The method of claim 1, further comprising:

designating at least some pixels in the image data as bright pixels based upon the histogram bin identified by gray scale values of the bright pixels;

applying a contrast adjustment gain identified in the histogram bin.

3. The method of claim 1, wherein each bin value is adjusted using a piece-wise linear function.

4. The method of claim 1, wherein determining the display backlight level comprises:

measuring the ambient light level in an environment; and mapping measured ambient light to a display backlight value.

5. The method of claim 4, wherein mapping the measured ambient light level comprises applying a piece-wise linear function to the measured ambient light to produce the display backlight level.

6. The method of claim 4, wherein the display backlight value is set by a user.

7. The method of claim 6, wherein the display backlight value set by the user is adjusted based upon the ambient light to determine the display backlight level.

8. The method of claim 6, wherein the display backlight level is adjusted to be higher than the display backlight value set by the user if an actual ambient light value is brighter than set by the user.

9. The method of claim 6, wherein the display backlight level is adjusted to be lower than the display backlight value set by the user if an actual ambient light value is darker than set by the user.

10. A method, comprising:

determining a backlight value for a display; and determining a weighted histogram of image pixel values of original image data, wherein each count added to a histogram bin in the weighted histogram is weighted by a value of an image pixel, and each histogram bin of the weighted histogram is mapped to a bin backlight value;

adjusting pixel values in the original image data to compensate for the backlight value to produce compensated pixel values, wherein adjusting the original image data comprises using the backlight value and the pixel values in the original image data as indexes into two one-dimensional look-up tables developed using the weighted histogram to produce a content backlight value and content-based compensation weights for each pixel in the incoming image data.

11. A method, comprising:

receiving image data at a processor;

determining a weighted histogram of image pixel values of image data, wherein each count added to a histogram bin in the weighted histogram is weighted by a value of an image pixel, and each histogram bin of the weighted histogram is mapped to a bin backlight value;

using input pixel values in the image data to index a one-dimensional look-up table stored in memory to access adjusted pixels values for the image data, wherein the adjusted pixel values are based upon a weighted histogram of the image data;

applying a compensation weight to the adjusted pixels values to produce compensated pixel values;

adjusting a value for a backlight based upon an average pixel value, an average adjusted pixel value and the compensation weight.

12. The method of claim 11, further comprising:

designating at least some pixels in the image data as bright pixels based upon the histogram bin identified by gray scale values of the bright pixels;

applying a contrast adjustment gain identified in the histogram bin.

13. The method of claim 11, wherein determining a display backlight level comprises:

measuring ambient light in an environment; and mapping measured ambient light to the display backlight value.

14. The method of claim 13, wherein mapping the measured ambient light comprises applying a piece-wise linear function to the measured ambient light to produce a display backlight value.

15. The method of claim 11, wherein determining the display backlight value comprises the value for a backlight set by a user.

16. The method of claim 15, wherein value for a backlight set by the user is adjusted based upon an ambient light.

17. The method of claim 15, wherein the value for a backlight set by the user is adjusted to be lower than set by the user if an actual ambient light value is darker than set by the user.

18. The method of claim 15, wherein the value for a backlight set by the user is adjusted to be higher than set by the user if an actual ambient light value is brighter than set by the user.

* * * * *